United States Patent [19]

Steele

[11] Patent Number: 4,668,127

[45] Date of Patent: May 26, 1987

[54] MOBILE, OFFSHORE, JACK-UP, MARINE PLATFORM ADJUSTABLE FOR SLOPING SEA FLOOR

[75] Inventor: James E. Steele, Beaumont, Tex.

[73] Assignee: Bethlehem Steel Corporation, Bethlehem, Pa.

[21] Appl. No.: 854,847

[22] Filed: Apr. 22, 1986

[51] Int. Cl.[4] ..... E02B 17/08

[52] U.S. Cl. ..... 405/198; 405/196; 405/203

[58] Field of Search ..... 405/195–200, 405/203, 204; 254/105, 96, 98, 102

[56] References Cited

U.S. PATENT DOCUMENTS

| | | | |
|---|---|---|---|
| 3,245,658 | 4/1966 | Sutton | 405/198 X |
| 3,289,419 | 12/1966 | McGowen | 405/203 X |
| 3,290,007 | 12/1966 | Yeilding | 405/198 X |
| 3,396,945 | 8/1968 | Schreier et al. | 405/199 X |
| 3,927,535 | 12/1975 | Giblon | 405/203 |
| 4,497,591 | 2/1985 | Gillis | 405/198 |
| 4,583,881 | 4/1986 | Steele | 405/196 X |

FOREIGN PATENT DOCUMENTS

| | | | |
|---|---|---|---|
| 2383119 | 11/1978 | France | 405/196 |
| 0069916 | 4/1983 | Japan | 405/196 |

OTHER PUBLICATIONS

"The Bethlehem 600", brochure dated Oct. 1984.

*Primary Examiner*—Dennis L. Taylor
*Attorney, Agent, or Firm*—Ladas & Parry

[57] ABSTRACT

A mobile, offshore, jack-up, marine platform, adjustable for sloping sea floor having a mat, a multilegged column pivotally connected thereto and a work platform slidably mounted on the column. Means are included for independently vertically adjusting at least one leg and/or offset ballasting of the work platform.

20 Claims, 16 Drawing Figures

MOBILE, OFFSHORE, JACK-UP, MARINE PLATFORM ADJUSTABLE FOR SLOPING SEA FLOOR

BACKGROUND OF THE INVENTION

This invention relates to mobile, offshore, jack-up, marine platforms of the type used to explore for and produce oil and natural gas from locations under the sea, and particularly from locations under substantial depth of sea water, such as depths of about six hundred feet. Such locations may have sloping sea floor which would cause unacceptable tilting out of vertical of a platform mounted on a central column which is connected to a mat positioned on the sea floor. Such platforms need to be adjustable for sloping sea floor, with a central column rigidly cross-braced to withstand wind and wave action upon the long central column. The apparatus of this invention satisfies the aforementioned needs.

SUMMARY OF THE INVENTION

The apparatus of this invention provides a jack-up marine platform for use as a drilling rig having a central column tiltable by means of legs independently pivotally fastened to a mat positioned on the sea floor. The work platform can also include fixed cantilevered arms and a universally movable skid further cantileverable along the arms. The work platform can be selectively ballasted based upon skid cantilever location. Means are included for independently raising and lowering each leg in relation to the mat, which means are sealed within each leg. Cross-bracing of the column can include at least one pivotally connected set of struts, to permit "flexing" of column as each leg is independently vertically adjusted.

The invention provides means for utilizing the invention subsequent to drilling, as a production center.

DESCRIPTION OF PREFERRED EMBODIMENT AND BEST MODE

GENERAL ARRANGEMENT

Figure 1:
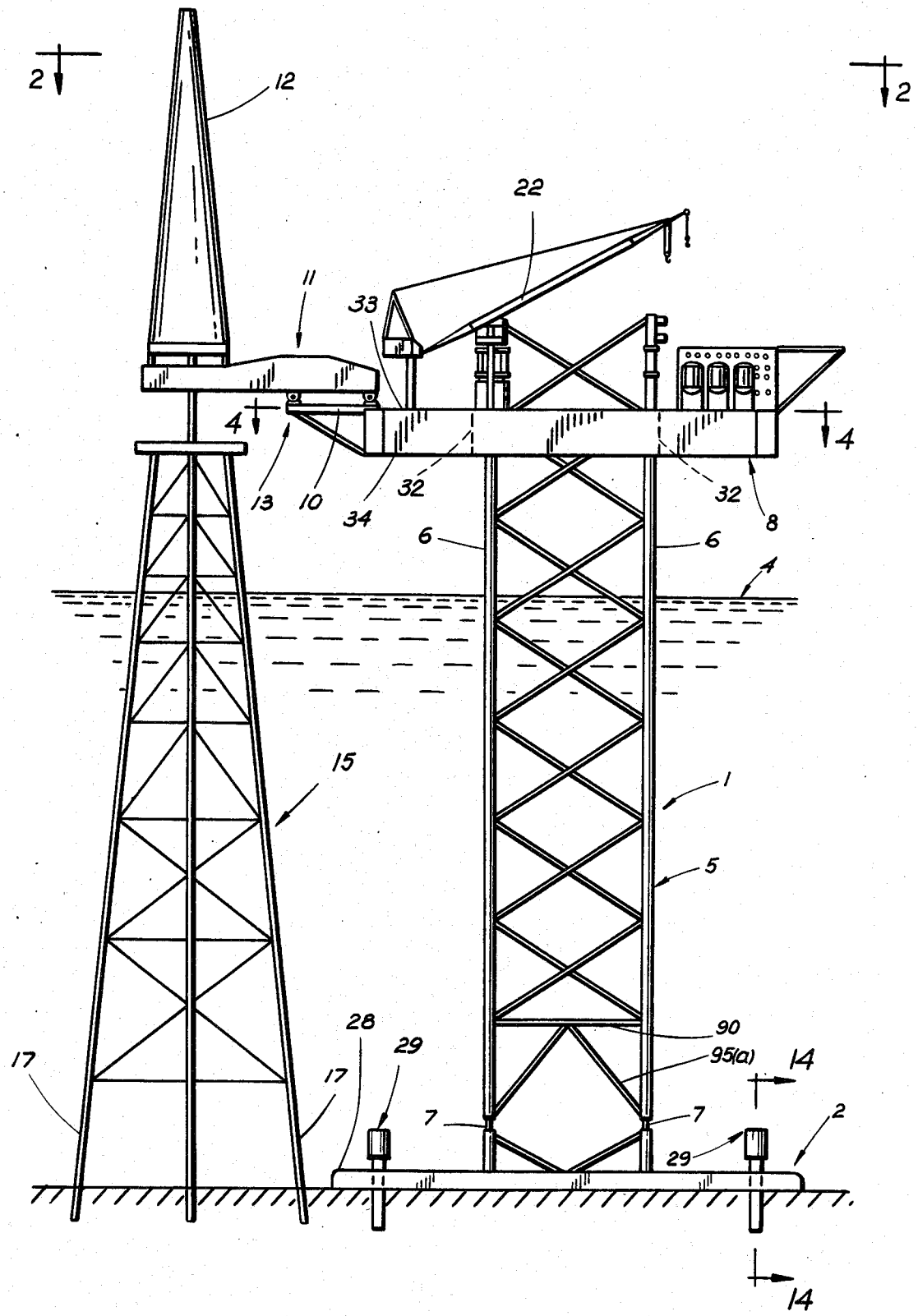
FIG. 1 is a schematic elevation of the mobile offshore platform of this invention being used as a drilling rig next to a fixed production platform.
Figure 5:
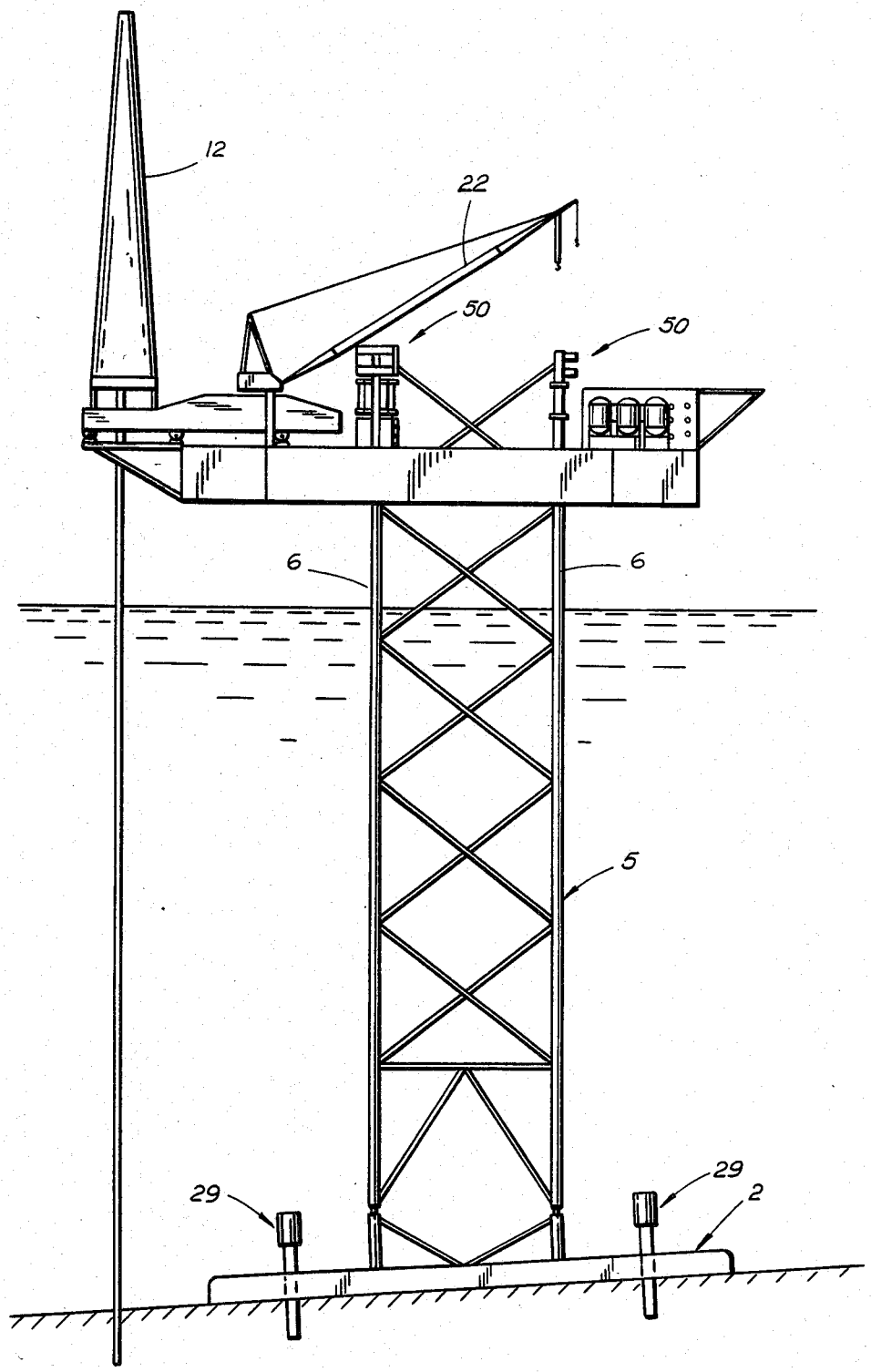
FIG. 5 is a schematic elevation of the mobile offshore platform being used as a drilling rig on an exploratory well on a sloping bottom.
Figure 6:
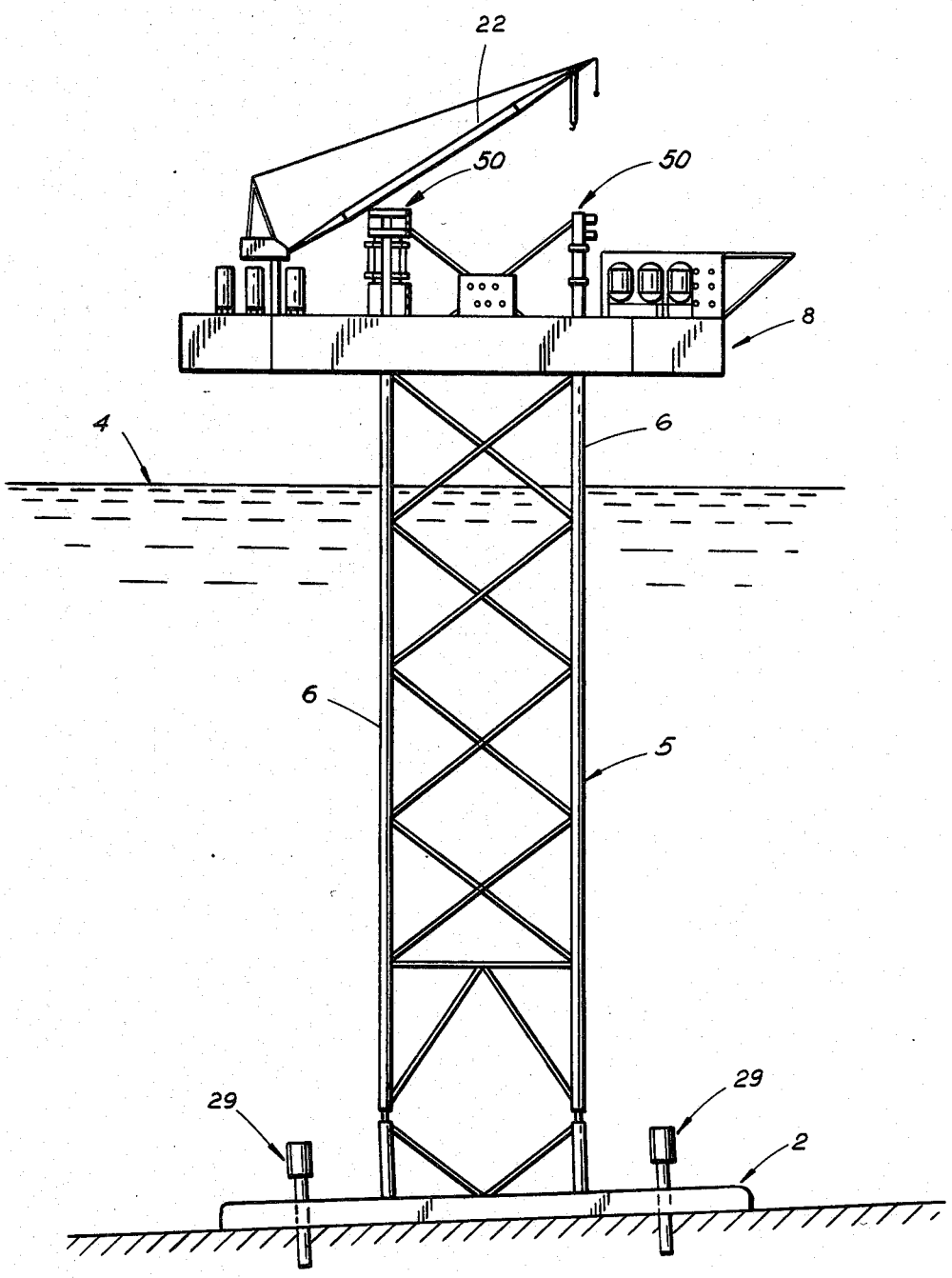
FIG. 6 is a schematic elevation of the mobile offshore platform being used as a production platform.
Figure 15:
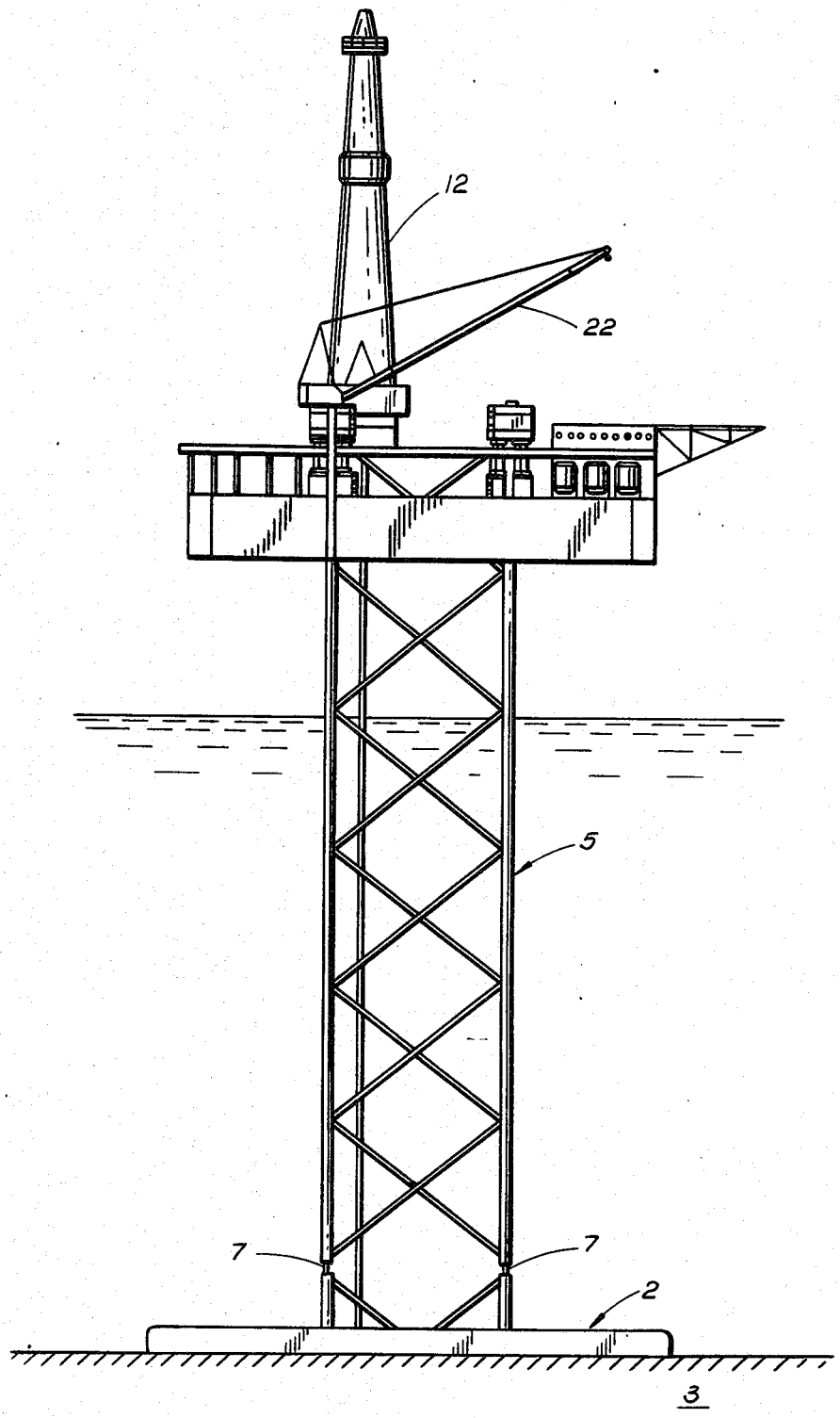
FIG. 15 is a schematic elevation of the mobile offshore platform being used as a combination drilling and production platform with wells going down through the column.

Referring to FIG. 1, there is shown the drilling rig 1, having a mat 2, for resting on bottom 3 below surface of water 4. Fastened to mat 2 is a central column 5, pivotally attached to mat 2. Each chord (or leg) 6 is pivotally fastened at connection 7, as will be described hereinafter. Central section 5 may be comprised of three legs arranged such that central section in horizontal cross-section is a three-legged triangular column. A four-legged square or rectangular cross-sectional column is preferred and is shown in FIG. 15 along with a front view of the right side jacking gear. FIGS. 1, 5 and 6 show a triangular column along with a side view of the right side jacking gear.

Column 5 extends vertically upward in excess of six hundred feet from mat 2 to extend above the surface of water 4. The height of column 5 is arbitrary, and is selected based upon the depth of water drilling rig 1 is to operate within.

Figure 2:
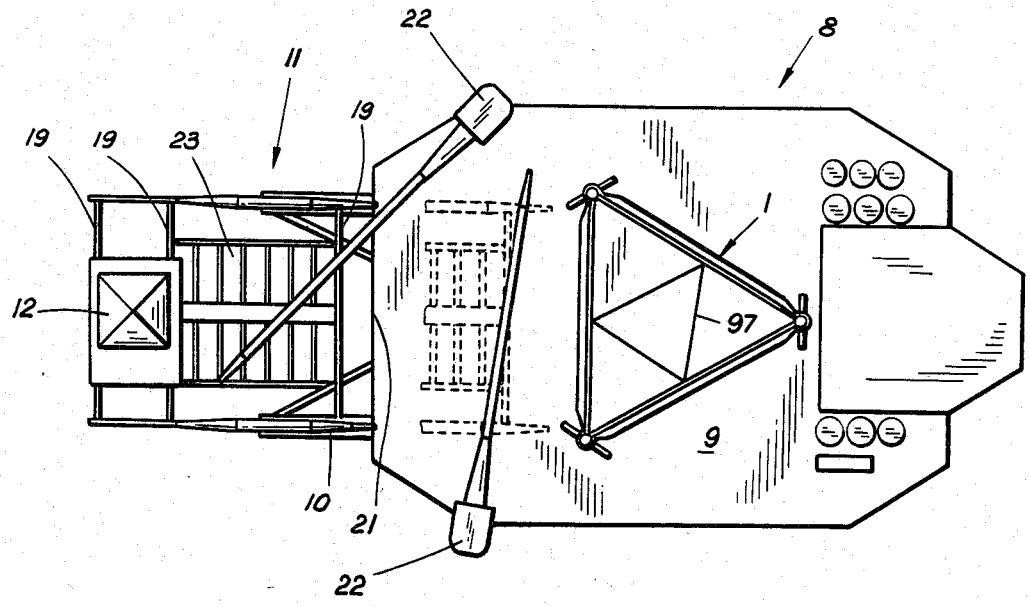
FIG. 2 is a schematic plan view of the top deck of the mobile platform being used as a drilling rig, along lines 2—2 of FIG. 1.

Slidably mounted on column 5 is jack-up work platform 8. As shown in FIG. 1 and 2, work platform 8 is mounted on column 5 so that Column 5 extends through central portion 9 of work platform 8. Work platform 8 includes an end portion extending outwardly from central portion 9 of work platform 8.

Movably mounted on work platform 8 is skid unit 11 carrying drilling equipment 12. Skid unit 11 is movable by conventional means (not shown) in a direction parallel to the end portion 10. As shown in FIG. 1, skid unit is movable to approximately the edge 13 to permit location of skid unit a substantial distance away from column 5. Thus, it is understood that the position of the skid unit 11 includes a fixed portion (arms 10) and a movable portion, such that skid unit 11 can be moved from adjacent the central portion 9 of work platform 8 to an extreme position outboard beyond end 13, as shown in FIG. 1. Skid unit 11 is moved toward central portion 9 during towing and positioning of drill rig 1, and skid unit 11 is moved to an extreme position when drilling rig 1 is positioned for working vertically above a drilling production tower shown generally as 15 in FIG. 1.

Because of the great depth of water, tower 15 extends upwardly a great distance, and requires a significant span of distance between legs 17 for stability. Mat 2 can only extend to legs 17 on bottom 3 and movable skid unit 11 must extend outwardly beyond mat 2 a sufficient distance to permit drilling equipment 12 to reach vertically above top of production tower 15.

Figure 3:
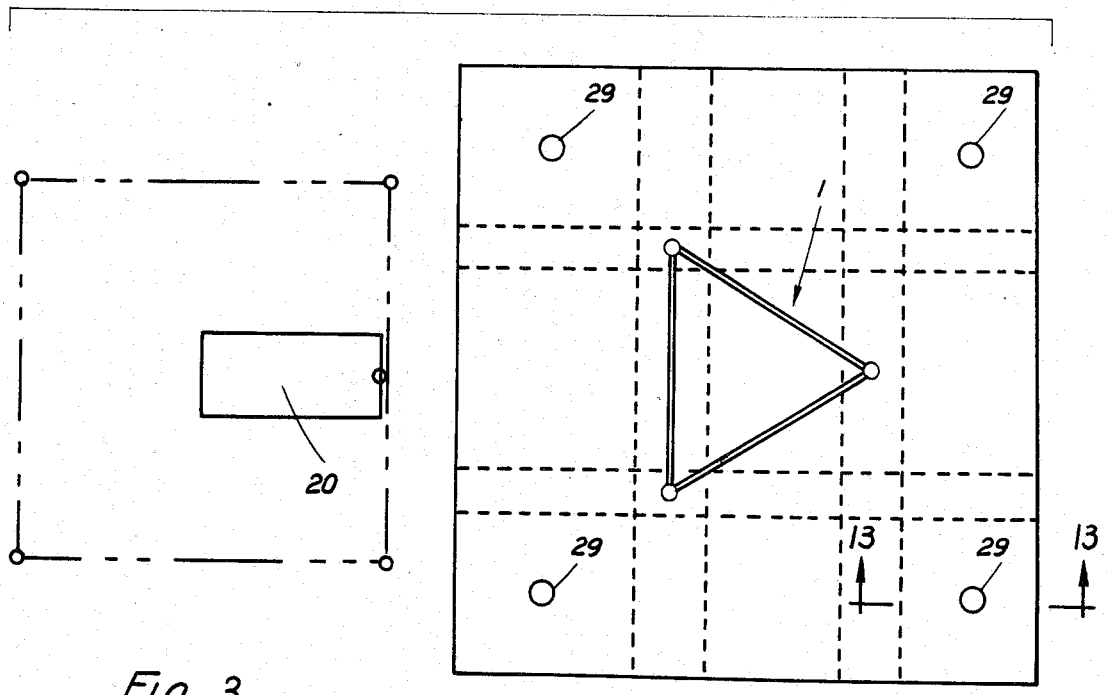
FIG. 3 is a plan view of the mat.

As shown in FIG. 2 and FIG. 3 drill unit 12 is movably mounted on rails 19 which laterally span fixed arms 10. Skid unit 11 is thus universally horizontally movable by reason of drill rig 12 ability to move along rails 19, in connection with movability of skid unit 11 along arms 10. Work area 20 between arms 10 and outboard of edge 21 of central portion 9 is serviced by universally movable skid unit 11, and work area 20 extends outwardly from between arms 10 by reason of the ability of skid unit 11 to be cantilevered out past edge 13 of arms 10. Thus, the combination of fixed and movable skid unit means significantly increases the work area serviced by skid unit 11, a very important advantage for large structures required for deepwater drilling.

It should be understood that the means for moving skid unit 11 and drilling rig 12 are not shown in detail because such means are conventional and can be achieved by means well known to those skilled in the art of marine drilling rig design. Also mounted on work platform 8 are conventional cranes 22, in various location, as is well known. Mounted on skid unit 11, is pipe storage rack 23. Storage rack 23 is shown located between drill rig 12 and central portion 9 of platform 8, and storage rack 23 moves with drill rig 12.

In an alternate embodiment of the invention, the invention can be used, first for drilling the wells and then subsequently as a production center while the wells are being produced.

In one embodiment, the platform can be designed to include a main deck and a raised deck located above the main deck. The space in between the raised deck and the main deck of the platform 8 would be sufficient to accommodate the separators, compressors, pumps and other equipment that is used in the production process. Another modification in this embodiment is in the arrangement of the skid unit. Rather than slide along the longitudinal direction of the platform 8, the skid unit instead has an increased scope of sliding in the transverse direction. In this arrangement, a number of wells would be drilled off the aft end of the platform 8 and the riser pipes for these wells would be supported by tension from the underside of platform 8. A small field would be produced requiring that the unit remain on location for approximately five to ten years and then be moved to another field when the field is exhausted.

In still another embodiment, the wells would be capped with a device known as a Christmas tree and a flexible hose would rise to the surface. Diver would be used or the Christmas tree would be lowered on guidelines to the well head. In this embodiment the wells would be completed at the bottom rather than having riser pipes that are supported by the platform 8.

In another embodiment, the skid unit 11 would be used first for drilling the wells and subsequently remain on location for several years while the wells are being produced. To accomplish that the skid unit 11 would be mounted so that it can be turned around 180 degrees in order that the derrick can be skidded over the tower. The well riser pipes can then be supported by means of braces which are within the tower and which are attached to the tower structure. This is the same procedure which is presently used in fixed platforms. In order to permit the riser pipes to go through the mat 2 two possible approaches can be used. The first approach is to have individual pipe sleeves pass through the mat 2 at the location of each well. The second approach is a "moon pool" or an opening built within the mat structure which is large enough to contain all the riser pipes.

This arrangement will only work if the platform is jacked all the way up to the top of the tower. This is no problem for the first location where the tower may be built to suit. For subsequent locations in a lesser depth of water, two solutions are possible. Either the unit may be taken back to the shipyard and the tower reduced in height or some scheme may be worked out in which the bracing on the aft side of tower may be modified or temporarily removed to permit the passage of the skid unit.

THE MAT

As shown in FIGS. 1 and 3, mat 2 is essentially rectangular in plan view. Mat 2 is constructed with a plurality of hollow, water-tight chambers 24 defined by intersecting plates 25 and top and bottom surfaces 26 and 27 of mat 2. Chambers 24 are equipped with conventional valve means (not shown) which can be opened and closed in order to selectively admit sea water for the purpose of flooding mat 2 at selected times. The valve means are operable from the working platform 8 by means of conventional connections (not shown) such as hydraulic controls, when mat 2 is in the raised position next to surface 4. Also operably connected to chambers 24 are conventional means (not shown) for forcing air into one or more chambers 24 for the purpose of expelling sea water from chambers 24 in order to deballast mat 2, so as to reduce the weight thereof. Means for forcing air into chambers 24 is also operably connected to work platform 8, so as to be operable when mat 2 is adjacent to surface 4.

Mat 2 may be equipped with rounded upper edges 28 for reducing water resistance during towing of mat 2 to location, as well as for minimized resistance to underwater currents and improved resistance to scour when mat 2 is on bottom 3.

Figure 13:
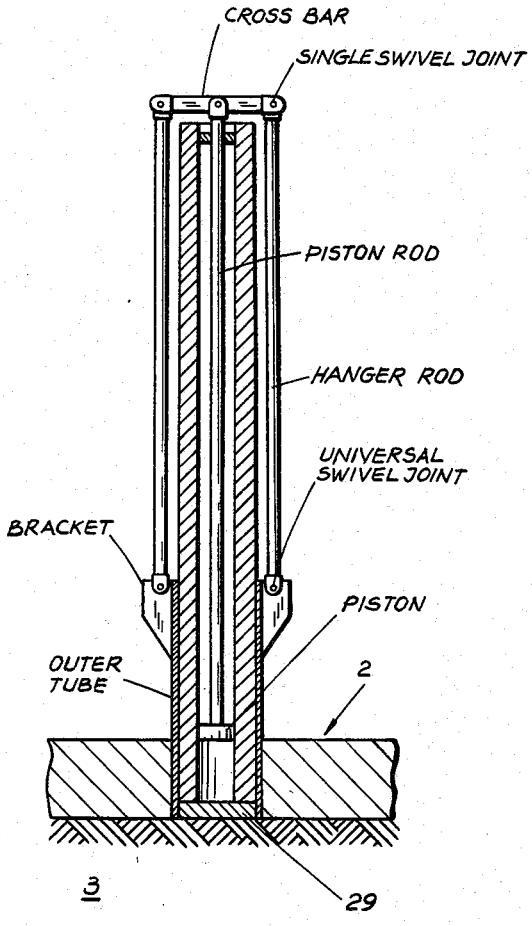
FIG. 13 is a sectional elevation through a spud as taken through cross section 13—13 of FIG. 3 showing the spud in the stowed position.
Figure 14:
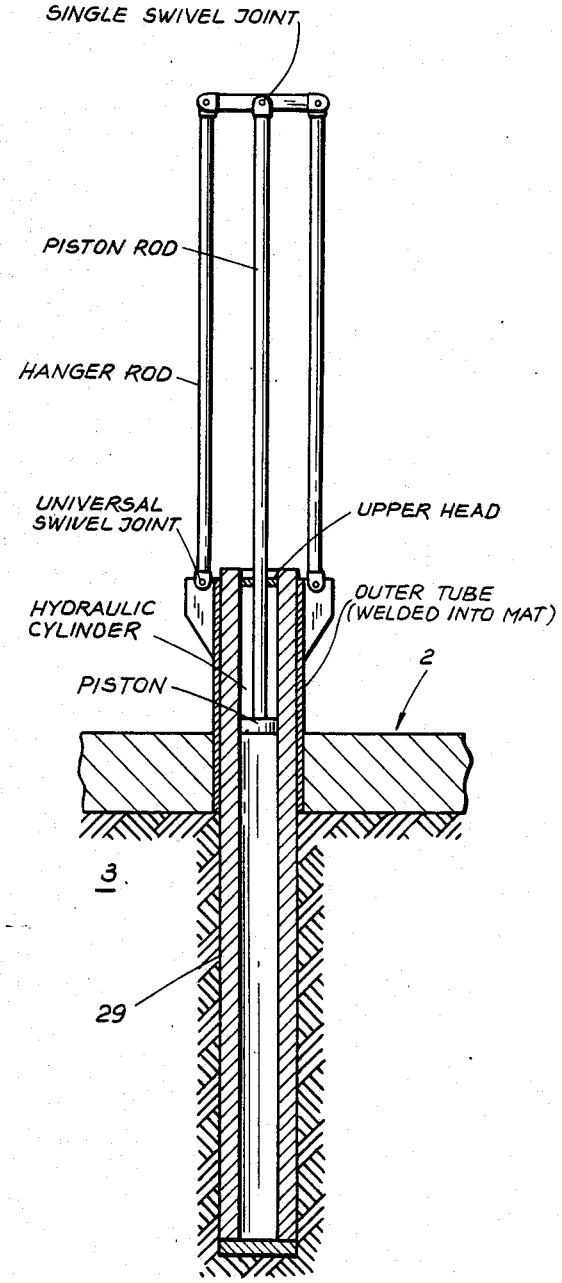
FIG. 14 is a sectional elevation through a spud as taken through cross section 14—14 of FIG. 1 showing the spud engaged with the soil.

Also shown on mat 2 are optional spuds 29 extending though mat 2 for anchoring mat 2 into bottom 3. Spuds 29 are hollow and are raisable and lowerable through channels 30 in mat 2 by means of hydraulic cylinders 205 in the spuds 29 as shown in FIGS. 13 and 14. Spuds 29 can be lowered into position by the cylinders 205 which are acutated after mat 2 is on the sea floor and preferably the platform is elevated. After spuds are positioned, pins (not shown) can be inserted between spuds 29 and mat 2 to lock spuds 29 into position.

As shown in FIGS. 13 and 14, spuds 29 are preferably hollow, tubular in cross-section having internal heads 31 sealingly located therein to provide internal water-tight compartments to aid in floating and removal of spuds 29.

THE WORK PLATFORM

Figure 4:
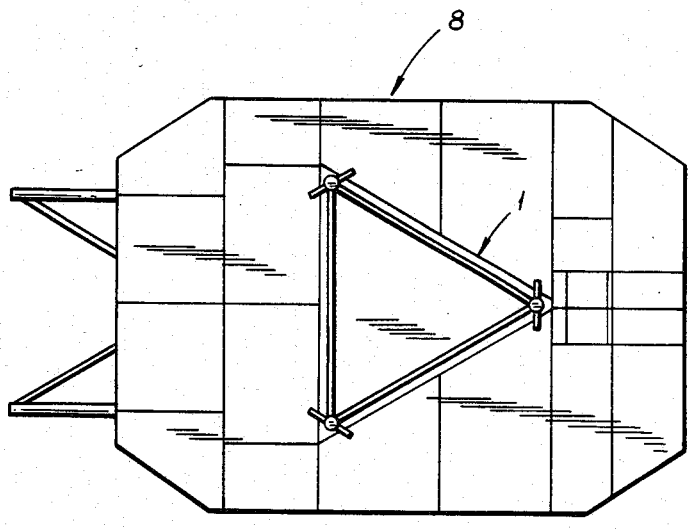
FIG. 4 is a cross section through the mobile platform being used as a drilling rig, along lines 4—4 of FIG. 1.

As shown in FIG. 1 and FIG. 4 work platform 8 is comprised of a plurality of compartments formed by interconnected vertically extending plates 32 (FIG. 1) welded to top and bottom decks 33 and 34 respectively. As seen in FIG. 1 and FIG. 4, plates 37 extend vertically between top and bottom decks 33 and 34, as well as longitudinally between sides 35 and 35(*a*). Plates 38 extend vertically between decks 33 and 34 as well as longitudinally between plate 37 and 2. In combination, the plates 37 and 38 form the inner wall of first below deck work area, as well as the opening in central area of work area 8 for passage of central column 5. Horizontally extending plates 32 are welded between sides 35 and 35(*a*) as well as 36 and 36(*a*) of work platform 8. In combination the plates 32, 32(*a*) extending vertically between decks 33 and 34 and extending horizontally between sides 35, 5(*a*), 36 and 38 form a first work area between top and bottom decks 32 and 33. As shown in FIG. 1 first below deck work area can be divided into a plurality of work levels and work rooms by appropriately located horizontal deck plates 39 and vertical plates 40.

As shown in FIG. 1 and FIG. 5, a second below deck work level is provided by horizontally positioned plate 41 extending parallel to top deck 33 and bottom deck 34 in central portion 9. Plate 41 extends between plates 35 and 35(*a*); 35, 35(*a*) and 38; 36, 36(*a*) and 38. By apex end 42, is meant the end corresponding to an apex formed by triangularly placed column legs 6. It will be understood that triangular column 5 has a pair of legs 6 placed adjacent each cantilevered arm 10, forming the base of an equilateral triangle (as viewed in horizontal cross section), with the third leg 6 placed opposite arms 10 to form the apex of the aforementioned triangle.

Each of the compartments in apex end 42 are ballastable, that is, equipped with conventional valve means and pumping means (not shown) which can be used to fill and empty the compartments.

Ballasted apex end 42 is selectively filled and emptied with ballast water in conjunction with how far skid unit 11 is cantilevered out along arms 10. Living quarters 44 are positioned over apex end 42 to add ballast.

The location of equipment in the remaining below-deck compartment as well as on the work deck itself is distributed so as to provide weight generally evenly distributed around column 5. Thus, there is provided, in connection with ballastable compartments of apex end 42 a drill rig of enhanced ability to reach far out over a drill tower and still keep the center of the load over the center of the column 5 and mat 2, a very important feature for deep water structures.

The central column is triangular in cross section but it could also be square or rectangular, in which case apex 42 would be replaced by a second pair of legs 6 spaced parallel to the first pair of legs adjacent arms 10. The ballastable compartments could be adjacent the second pair of legs 6.

There are advantages for the square tower and for the triangular tower. The advantage of the square column is a more redundant structure in case it is it hit by a supply boat.

The mat many have rounded corners along its upper deck edges. Past model tests have shown that this configuration helps to resist scour. This is considered important in the North Sea.

THE JACK-UP MECHANISM

As shown in FIG. 5, located on each leg 6 of column 5 is a jack-up mechanism 50 for moving work platform 8 up and down in relation to mat 2 and column 5.

Figure 7:
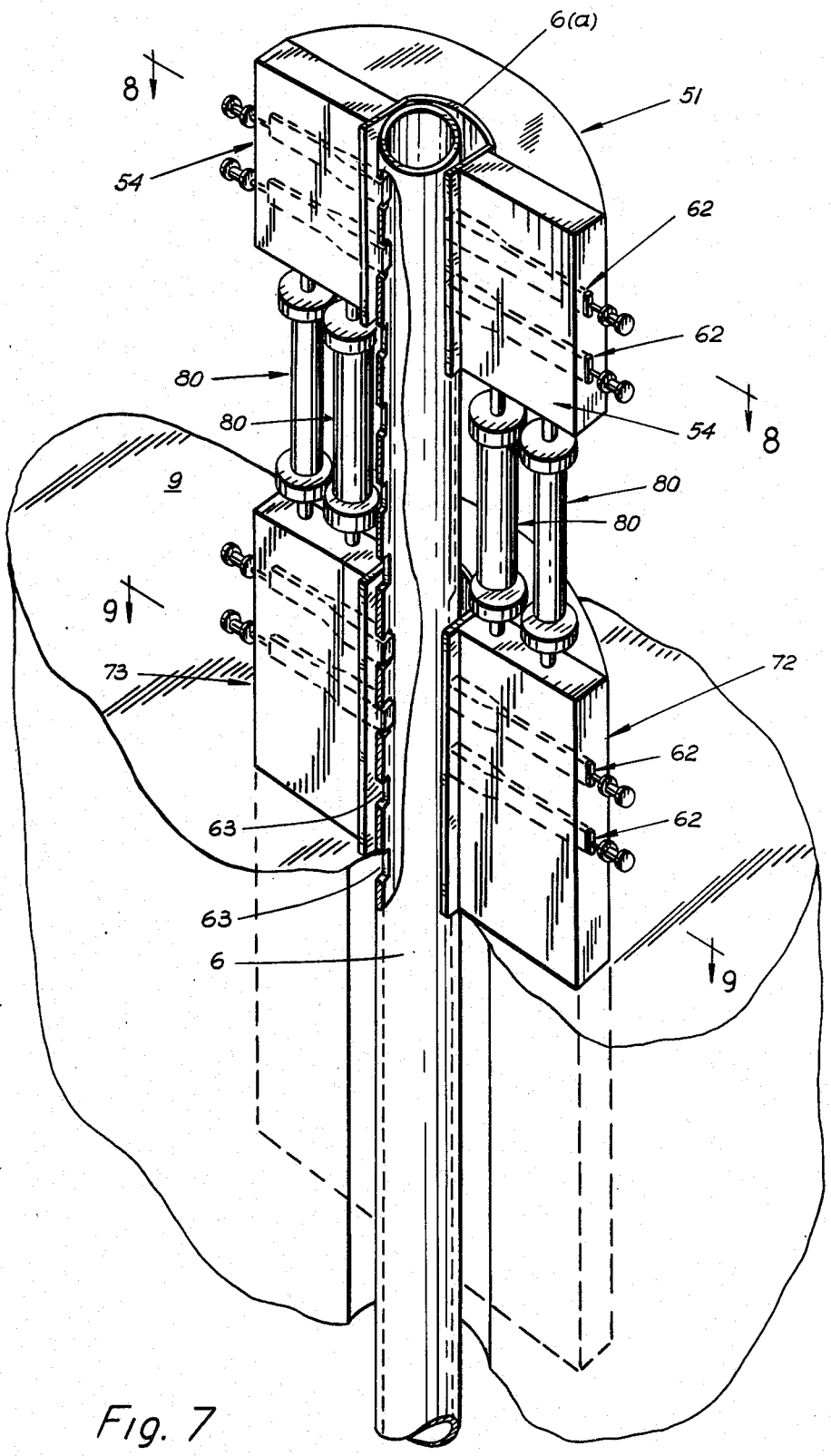
FIG. 7 is a perspective schematic view of a jack-up means used to move the work platform up and down with respect to the mat and the tower of the platform.
Figure 16:
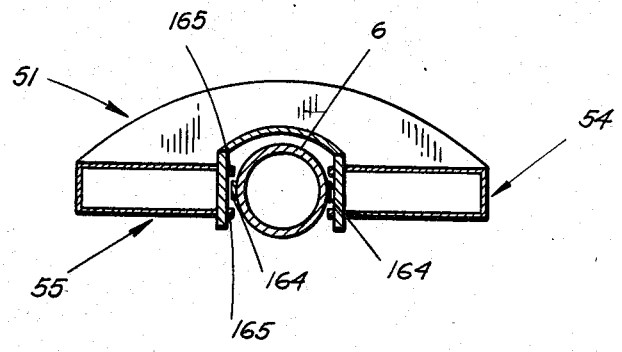
FIG. 16 is a cross section through the pin box in way of the vertically disposed guide plates.
Figure 9:
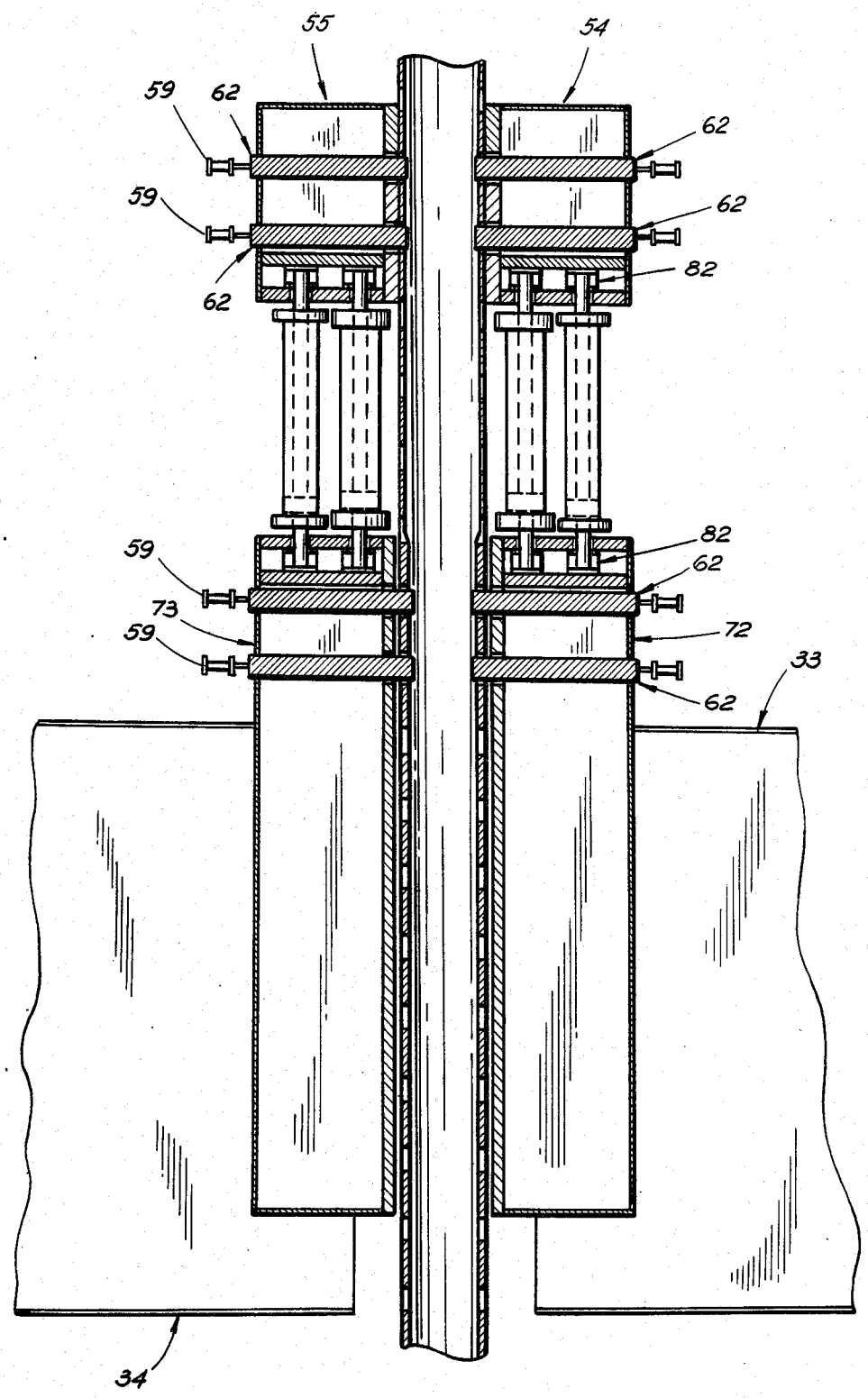
FIG. 9 is an elevational view in cross section 9—9 of FIG. 7.

The jack-up means 50 includes a movable semicircular yoke 51 (FIGS. 7, 8 and 16) spaced from and spanning an outer periphery 6(*a*) of hollow-tubular leg 6 of column 5. Yoke 51 spans outer periphery 6(*a*) because the inner periphery is taken up with cross bracing members, as will be described hereinafter.

Movable yoke 51 includes upper bracket 52 and lower bracket 52(*a*) fixedly connected together by vertically extending side plates 53. Fastened to sideplates 53 in opposing relationship at the diametrically opposed positions on leg 6 is a first and second pin box 54 and 55. Each pin box is essentially the same, and the description of one pin box 54 or 55 also describes the other.

Figure 8:
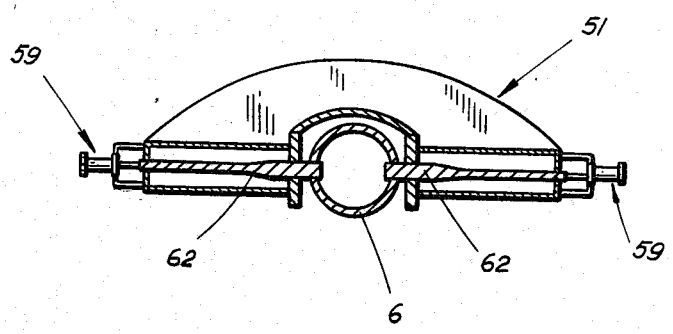
FIG. 8 is a plan view in cross section 8—8 of FIG. 7.

Pin box 55 includes vertically extending side plates 56 rigidly connected together by end plates 57. Each pin box 55, is a rigid hollow member, generally rectangular in horizontal cross section, further divided into a plurality of verticaly spaced compartments by horizontally extending pin box plates 58 (FIG. 8.). Fixedly mounted within each compartment is a horizontally-oriented hydraulically-operated cylinder and pin assemblies 59, 62. Cylinder and Pin assembly 59, 62 is operated by conventional hydraulic means, such as air, through conventional inlet and outlet Ports 60, 61 to operate anchor pin 62 selectively into and out of every alternate diametrically opposed slots 63 in leg 6. Thus, each pin box 54, 55 carries a plurality of vertically-spaced, horizontally-oriented piston and cylinder assemblies to selectively drive anchor Pins 62 into and out of each alternately vertically spaced opening 63 in leg 6. It would be equivalent to provide a cylinder which is capable of driving more than one anchor pin 62, up to and including all such anchor pins in a given pin box.

The spacing between pin holes 63 alternates along leg 6 between a shorter and a longer space. The jack stroke is long enough to span two spaces. Thus a given pin 62 always enters the same pin hole 63.

Movable yoke 51 is free to move vertically along leg 6. Attached to leg 6, along the lines of apperatures are two vertically disposed lines of guide plates 164. These guide plates 164 engage with brackets 165 on the inner faces of the pin boxes 54, 55 on movable yoke 51.

Spaced vertically below semicircular movable yoke 51 are pin boxes 72, 73. Pin boxes 72, 73 are constructed similarly to pin boxes 54, 55 described above. However, pin boxes 72, 73 extend vertically downward through slots in top deck 33 and any intervening plates in work areas below top deck 33, with each pin box contacting lower deck 34. Each pin box is permanently affixed to top deck 33 and to lower deck 34. (FIG.6). Thus, it should be understood that pin boxes 72, 73 are permanently attached to work platform 8, and as pin boxes 72, 73 move up and down in relation to legs 6, entire work platform 8 also so moves up and down.

Located within each pin box 72, 73 is a plurality of vertically-spaced, horizontally-oriented hydraulic cylinder and pin assemblies 59, 62, for selectively engaging opening 63 in leg 6 by means of anchor pins 62. It should be understood that the detailed structure internally and externally of pin boxes 72, 73 is similar to that described for pin boxes 54, 55 hereinabove, and will not be repeated here. It is preferable that each pin box 72, 73 includes two horizontally-oriented cylinder and pin assemblies. Each pin box 54, 55 also includes two such assemblies.

Interconnecting the upper and lower pin boxes, 54, 55 and 72, 73 is a plurality of vertically-oriented hydraulic piston and cylinder assemblies 80. A description of one assembly 80 will suffice for all, since all are the same. Assembly 80 has its base 81 pivotally attached to top of lower pin box 72, 73 by means of a spherical bearing assembly 82, of conventional design. The spherical bearing assembly 82 provides a pivotable connection between cylinder assemblies 80 and pin boxes 72, 73 to adjust for slight misalignments between legs 6 and work platform 8.

Upper piston rod 83 is also pivotally fastened to the bottom of pin boxes 52, 53 by means of a second conventional spherical bearing arrangement 82 (*a*). By reason of first and second spherical bearing arrangements 82 and 82 (*a*) piston and cylinder assemblies are universally pivotal to permit adjustment for misalignment between legs 6 and jack-up means 50. I prefer to provide two such piston and cylinder assemblies 80, between each pair of upper pin boxes 54, and its corresponding lower pin box 72, and 55/73 respectively. A different number of such piston and cylinder assemblies can be chosen depending upon the anticipated load to be carried and moved.

THE COLUMN

As shown in FIG. 1, FIG. 5 and FIG. 6, column 5 is a three-legged, cross-braced, tower, being triangular in horizontal crosssection, the tower having vertical legs 6 formed from hollow tubular members. Connecting each pair of legs 6 is a horizontally disposed outer strut 90 in a first horizontal plane 91 adjacent mat 2. Outer strut 90 is preferably formed from two pieces which are pivotally connected at midpoint 92 by means of conventional pin 93 and bracket 94. Also pivotally fastened at mid point 92 is a pair of diagonal struts 95, each diagonal strut 95 tending diagonally downward to fixedly connect to a different leg of the pair of legs 6. The arrangement of outer struts 90 and diagonal struts 95 is shown pivotally connected at the first horizontal level of struts above the mat 2. At successive elevations 96 above the first level 91, the outer struts 90 (*a*) are similarly located and disposed with respect to each pair of legs 6. Likewise, each pair of diagonal struts 95(*a*) is also similarly located and disposed to struts 95 hereinbefore described. However, at each successive elevation 6 struts 90(*a*) and 95(*a*) are fixedly connected at midpoints whereas struts 90 and 95 are preferably pivotally connected. The reason for pivotal connection will become apparent hereinafter when vertical adjustment of tower legs 6 is explained. Finally, fixedly connecting each Pair of horizontal outer struts 90 or 90(*a*) at the midpoint of strut 90, 90(*a*) in a given plane, is an inner strut 97 (see FIG. 2) generally horizontally disposed.

In combination, the three legs 6, cross-braced at a given horizontal plane by outer horizontal struts 90, 90(*a*), diagonal struts 95, 95(*a*) and inner horizontal struts 97 provide a single tower, cross braced independently from the adjustable working platform 8. Such independent cross bracing, which does not rely on cross bracing support from work platform 8, provides significant stiffness against wind and wave action, when the mat 2 is located on bottom 3, about six hundred feet below surface of water 4.

As described above, the column could also be four-legged and square or rectangular in horizontal cross-section.

THE TILTING MECHANISM

Figure 10:
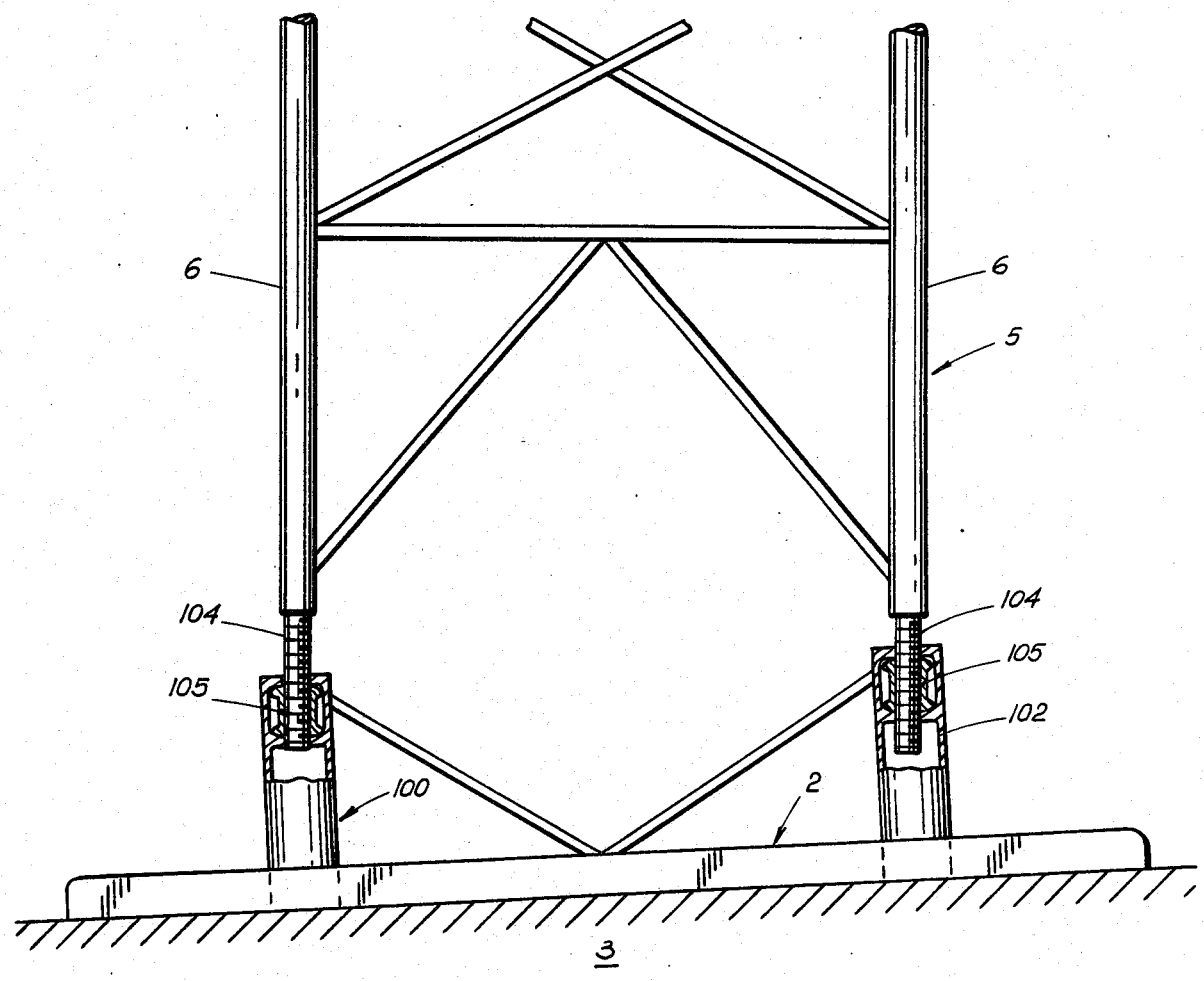
FIG. 10 is a schematic elevation of the mechanisms for adjusting the angle of the tower on the mat.
Figure 11:
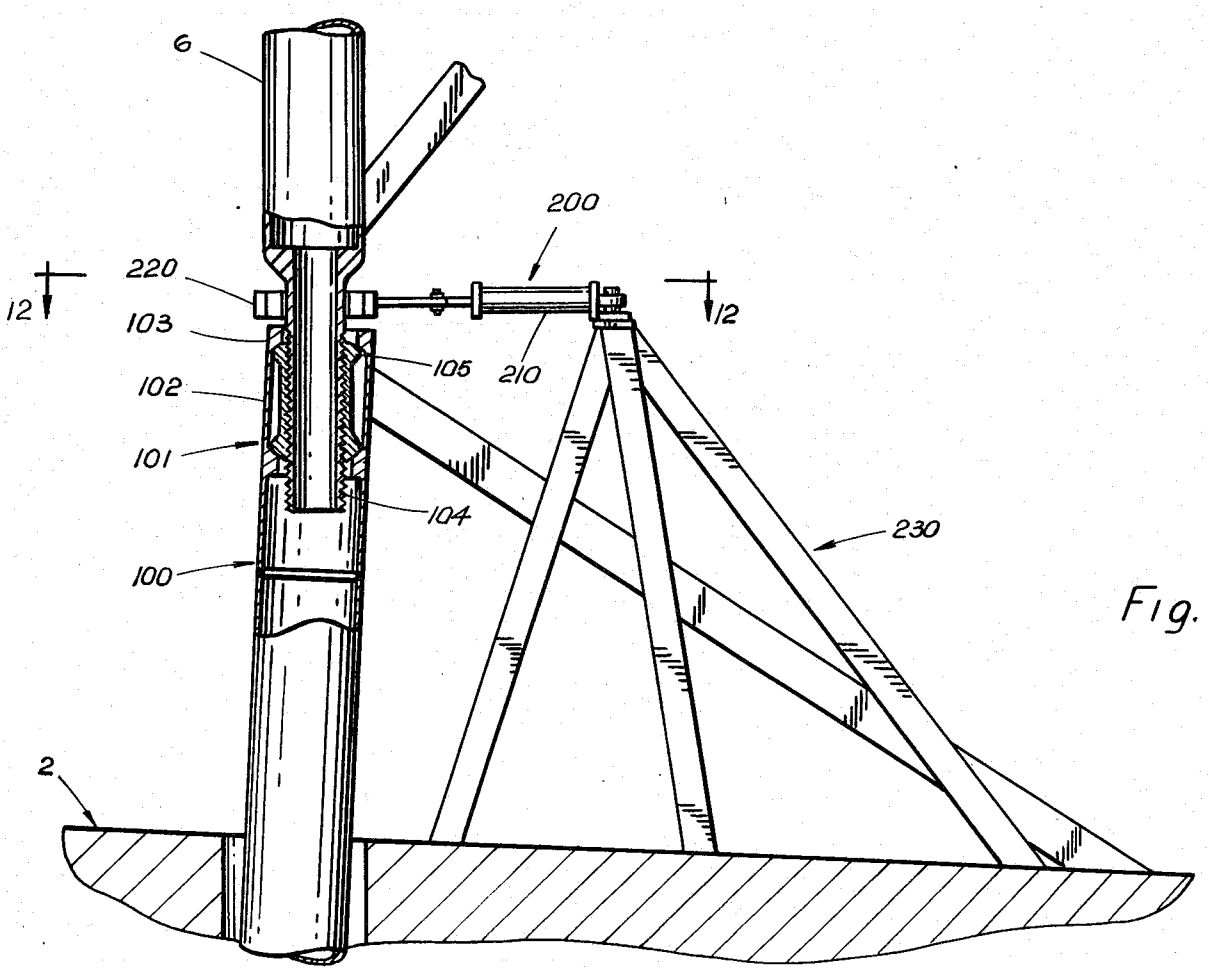
FIG. 11 is an enlarged view of one of the mechanisms for adjusting the angle of the tower on the mat.
Figure 12:
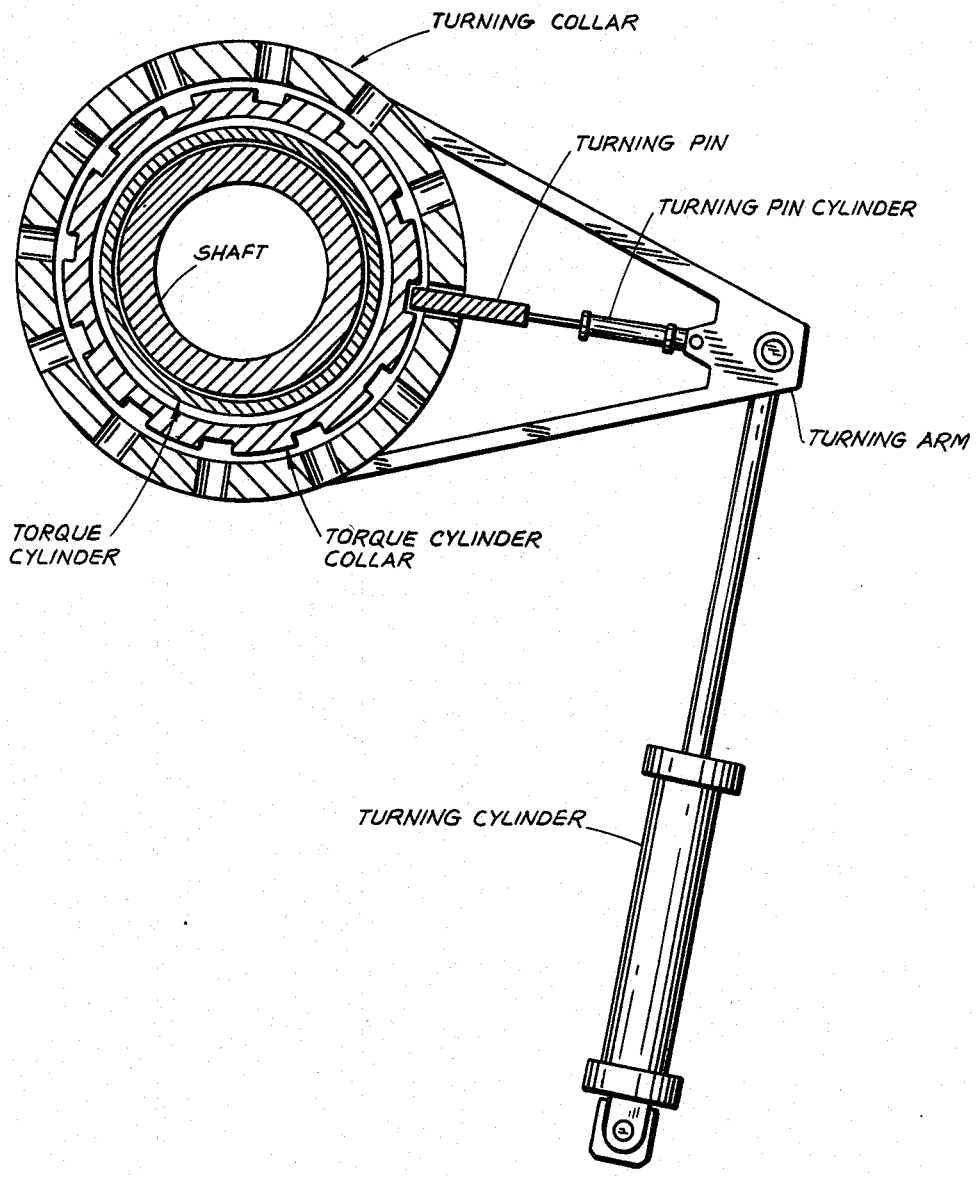
FIG. 12 is a plan view on cross section 12—12 of FIG. 11.

As shown in FIGS. 10, 11 and 12 one means for tiltably adjusting column 5 for sloping bottom 3 is disclosed. Permanently fixed within mat 2 is lower leg portion 100 carrying lower spherical bearing 101. Lower leg portion extends upwardly above mat 2 with hollow tubular section 102 which terminates with internal upper spherical bearing Pad 103 therein.

Located within each hollow tubular leg 6 is a threaded shaft 104 having a nut 105 with a spherical exterior thereon which is loosely confined in the upper section of tubular section 102. A nut turning mechanism is utilized to rotate the nut 105 and thereby tiltably adjust column 5. The nut turning mechanism 200 includes a hydraulic cylinder 210 for rotating the nut 105 as shown in FIG. 11.

The nut turning mechanism 200 is supported by a tripod 230 mounted on the mat 2. It understood that any other conventional rotating means may be employed for turning the nut 105 and the invention is not limited to a hydraulic design.

As shown in FIG. 12 (*a*), lower terminus of leg 6 ends above raised section 102 of leg portion 100. Connecting leg 6 and raised Portion 102 in water tight fashion is flexible, accordion seal means 133, sealing surrounding leg 6 at 134 such as by means of rubber gasket fitted against surface of leg portion 102 and lower terminus of leg 6. Likewise, seal 135 seals against raised portion 102. Located within water-tight leg 6 is a sealing fluid such as lubricating and corrosion protective oil. Sealing liquid is kept under pressure and in place against upper head plate 136, sealingly positioned inside leg 6. Not shown are optional means for lubricating bearing pad 103 and 101, 107 and 108. Accordion seal means is made from flexible metallic sheet and is vertically expandable and contractable. I prefer a vertical adjustment range of up to twelve feet.

By providing the drilling platform as herein described, there is an advantageous combination of features for rigs to operate in deep water, approaching six hundred feet. The combination of ballastable apex end 42 oppositely located to fixed cantilevered arms permits stability upon various cantilevered positions of movable skid unit. The work area 20 bounded by fixed cantilevered arms 10, inner edge 21 of work platform 8 and movable cantilvered skid unit 11 is substantially greater than that of conventional designs.

The single, cross braced column 5 being pivotally connected at each leg 6 to the mat 2 permits adjustment for sloping bottom. The combination of fixed and pivotable cross bracing permits independent vertical adjustment of each leg without including undue stress levels in cross bracing.

The means for vertically adjusting each leg, sealed in fluid within each leg and providing universally tilting configurations by means of spherical bearing pads operably inter-connected permits adjustment for sloping bottom.

While I have disclosed apparatus on each leg 6 for vertically and independently adjusting each leg 6 with respect to the mat 2, it would be equivalent to pivotally connect each leg 6 to the mat 2, but provide means for vertically adjusting less than all of such legs 6. Such arrangement is less mechanically complicated and, therefore, less expensive to construct. The particular leg to be so adjustable is a matter of choice, depending upon which direction the column 5 is to be tiltable with respect to the sea floor slope.

I claim:

1. A mobile, offshore, jack-up marine platform adjustable for sloping sea floor comprising:

(a) a mat;

(b) a tiltable column formed from a plurality of hollow tubular legs, each leg pivotally attached to the mat;

(i) means on at least one leg for independently vertically raising and lowering such leg with respect to the mat, to tilt the column;

(c) a jack-up work platform slidably mounted through its central portion on the column;

(d) a jack-up means interconnected between the work platform and each leg of the column for vertically moving the work platform with respect to the mat; each jack-up means including:

(i) a first and second vertically spaced pair of pin boxes spanning a portion of each leg;

(ii) a plurality of vertically-oriented piston and cylinder assemblies located on each side of said leg column for interconnecting said first and second pairs of pin boxes; and (iii) each pin box carrying a plurality of vertically spaced, horizontally-oriented piston and cylinder assemblies, each of which serves to selectively engage every alternately vertically-spaced aperture in the leg with a reciprocating anchor pin.

2. The invention of claim 1 in which the means (b) (i) on each leg includes:

(a) a threaded shaft connected to the hollow leg, and a nut threaded thereon having a spherical exterior; and (b) means for rotating the nut to raise and lower the leg in relation to the mat, said means including a hydraulic cylinder for turning said nut, said cylinder being mounted on a tripod located on said mat.

3. The invention of claim 2 further including a plurality of hollow anchoring spuds extendable through the mat into the sea floor, each of said spuds having a piston and cylinder assembly therein so as to actuate said spuds to be lowered when said mat is on the sea floor.

4. The invention of claim 1 wherein said jack-up means provides a jack stroke to span two said aperture spacings in said leg.

5. A mobile, offshore, jack-up, marine platform adjustable for sloping sea floor comprising:

(a) a mat;

(b) a tiltable column formed from a plurality of hollow tubular legs, each leg pivotally attached to the mat;

(i) means on at least one leg for independently vertically raising and lowering such leg with respect to the mat, to tilt the column;

(c) a jack-up work platform slidably mounted through its central portion on the column, the work platform including an end portion extending outwardly from the central portion and a ballastable portion opposite the end portion;

(d) a skid unit movably mounted on the end portion of the work platform; and (e) a jack-up means interconnected between the work platform and each leg of the column for vertically moving the work platform with respect to the mat; each jack-up means including:

(i) a first and second vertically spaced pair of pin boxes spanning a portion of each leg;

(ii) a plurality of vertically-oriented piston and cylinder assemblies located on each side of said leg for interconnecting said first and second pair of pin boxes; and (iii) each pin box carrying a plurality of verticall-spaced, horizontally-oriented piston and cylinder assemblies, each of which serves to selectively engage every alternately vertically-spaced aperture in the leg with a reciprocating anchor pin.

6. The invention of claim 5 in which the means (b) (i) on each leg includes:

(a) a threaded shaft connected to the hollow leg, and a nut threaded thereon having a spherical exterior; and (b) means for rotating the nut to raise and lower the leg in relation to the mat; said means including a hydraulic cylinder for turning said nut, said cylinder being mounted on a tripod located on said mat.

7. The invention of claim 6 further including a plurality of hollow anchoring spuds extendable through the mat into the sea floor, each of said spuds having a piston and cylinder assembly therein so as to activate said spuds to be lowered when said mat is on the sea floor.

8. The invention of claim 5 wherein said end portion forms a means for supporting said skid unit at said end portion of the platform.

9. The invention of claim 5 wherein said jack-up means provides a jack stroke to span two said apertures spacings in said leg.

10. The invention of claim 1 wherein said mat has rounded upper deck edges.

11. The invention of claim 1 wherein said platform includes a main deck and a raised deck located above the main deck wherein sufficient space is provided between the main deck and the raised deck for separators, compressors, pumps and other equipment for use in a production process.

12. The invention of claim 5, said platform having a longitudinal axis and wherein said skid unit is mounted so as to have an increased scope of sliding in a direction transverse to the longitudinal axis of said platform.

13. The invention of claim 5, wherein said skid unit is so mounted that it may be skidded over said column.

14. The invention of claim 13 wherein well riser pipes are located inside said column and are supported at appropriate intervals by braces located within said column.

15. The invention of claim 14 further comprising individual pipe sleeves which pass throuqh the mat and which are adapted to receive said well riser pipes.

16. The invention of claim 14 wherein said mat has an opening in which to contain said riser pipes.

17. The invention of claim 5 wherein said mat has rounded upper deck edges.

18. The invention of claim 5 wherein said platform includes a main deck and a raised deck wherein sufficient space is provided between the main deck and the raised deck for separators, compressors, pumps and other equipment for use in a production process.

19. The invention of claim 13 further including a derrick on said skid unit, said derrick being located to be positionable over said column.

20. The invention of claim 5 wherein said plurality of vertically-oriented piston and cylinder assemblies in said jack-up means consists of two hydraulic cylinders of unequal diameter located on each side of said leg, the innermost cylinders being of larger diameter than the outermost.

* * * * *